US007617825B2

(12) United States Patent
Pedemonte

(10) Patent No.: US 7,617,825 B2
(45) Date of Patent: Nov. 17, 2009

(54) CLOSURE DEVICE OF A SECOND-STAGE REGULATOR FOR SCUBA DIVERS

(75) Inventor: Stefano Pedemonte, Ceranesi (IT)

(73) Assignee: Cressi-Sub S.p.A., Genoa (IT)

( * ) Notice: Subject to any disclaimer, the term of this patent is extended or adjusted under 35 U.S.C. 154(b) by 0 days.

(21) Appl. No.: 10/899,204

(22) Filed: Jul. 26, 2004

(65) Prior Publication Data

US 2005/0016539 A1 Jan. 27, 2005

(30) Foreign Application Priority Data

Jul. 25, 2003 (IT) ..... FI20030071 U

(51) Int. Cl.
*A62B 7/04* (2006.01)
*F16K 31/26* (2006.01)

(52) U.S. Cl. ..... 128/204.26; 128/201.11; 128/201.27; 128/201.28; 128/201.29; 128/204.22; 128/204.27; 128/204.29; 128/205.11; 128/205.24

(58) Field of Classification Search ..... 128/201.11, 128/201.27, 201.28, 201.29, 204.22, 204.26, 128/204.27, 204.29, 205.11, 205.24
See application file for complete search history.

(56) References Cited

U.S. PATENT DOCUMENTS

| | | | | |
|---|---|---|---|---|
| 3,633,611 | A | 1/1972 | MacNiel et al. | 137/494 |
| 4,337,766 | A * | 7/1982 | Feathers | 128/204.26 |
| 4,616,645 | A | 10/1986 | Pederson et al. | 128/204.26 |
| 6,263,871 | B1 * | 7/2001 | Brown et al. | 128/200.29 |

FOREIGN PATENT DOCUMENTS

| | | |
|---|---|---|
| EP | 0019488 | 11/1980 |

* cited by examiner

*Primary Examiner*—Patricia Bianco
*Assistant Examiner*—Nihir Patel
(74) *Attorney, Agent, or Firm*—Pollack, P.C.

(57) ABSTRACT

A closure device of a second-stage regulator for scuba divers, the regulator comprising a regulator body with an inlet conduit for connection to a first-stage regulator which supplies a breathable gaseous mixture at relatively constant pressure, an outlet conduit for connection to a mouthpiece of the users, and an opening closed by a deformable diaphragm. The device comprises a locking frame connected in an articulated manner or jointedly to the regulator body to lock the diaphragm in the opening, and a member for fastening the frame to the regulator body.

9 Claims, 3 Drawing Sheets

Fig. 1
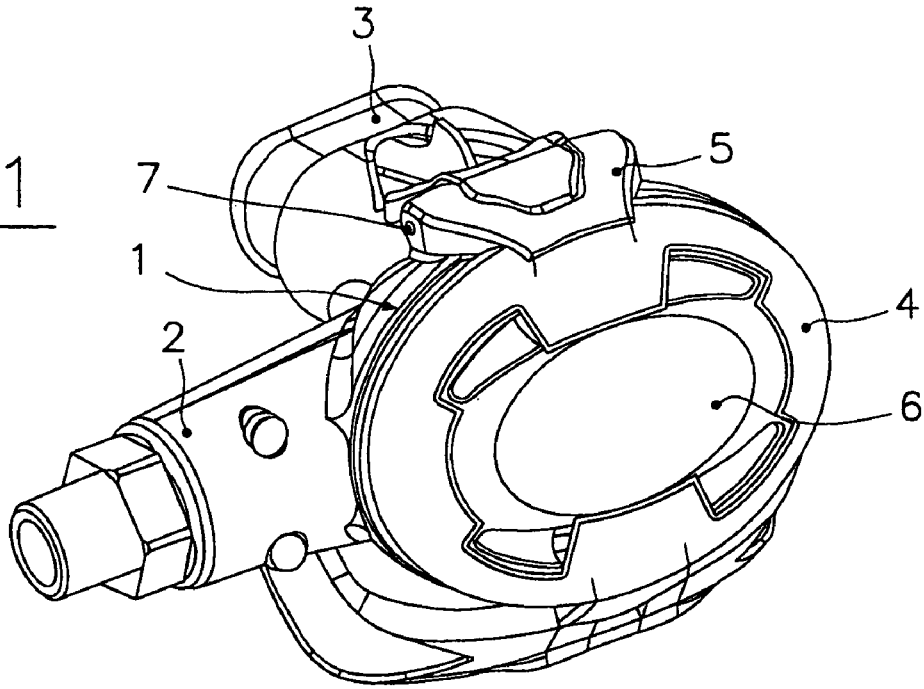
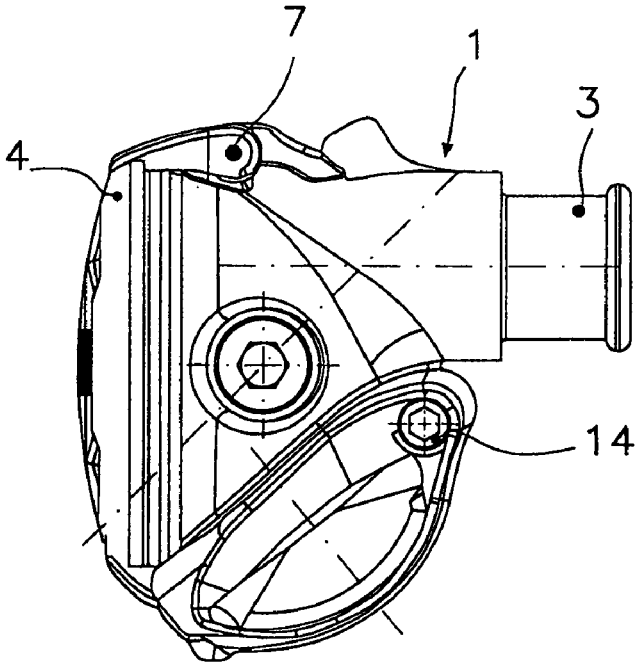
Fig. 2

CLOSURE DEVICE OF A SECOND-STAGE REGULATOR FOR SCUBA DIVERS

FIELD OF THE INVENTION

The present invention relates generally to equipment for use in limited oxygen environments and, more particularly, to a device for closure of a second-stage regulator for scuba divers.

BACKGROUND OF THE INVENTION

In scuba diving, for instance, a supply of air, or of an air-oxygen mixture, is typically fed to a mouthpiece of the scuba diver from a high-pressure tank. En route to the diver, the air passes via a first-stage pressure-reducing regulator to a second-stage regulator which, in turn, supplies the mixture to the mouthpiece, when pressure within the regulator is diminished upon the diver's inhalation.

Conventional second-stage regulators are usually provided with an inlet chamber connected to an outlet of the first-stage regulator, and an outlet chamber connected to a mouthpiece for the user. The outlet chamber is separated from the outside environment by an elastically deformable diaphragm that blocks an opening formed in the regulator body. The diaphragm is connected via a lever to a poppet which closes the passage between the two chambers. The pressure inside the inlet chamber is maintained relatively constant at approximately ten bars as the pressure in the tank varies, due to appropriate calibration of the first-stage regulator. When the user does not breathe, his or her lungs, the mouthpiece, the outlet chamber and the outside environment are at the same pressure. When the user inhales, however a vacuum is created inside the outlet chamber. This causes the diaphragm to bend toward the interior of the chamber, thereby moving the poppet, which normally closes the passage between the inlet and outlet chambers, to an open position.

Upon opening the passage between the inlet and outlet chambers, an overpressure is created in the outlet chamber, which causes the diaphragm to return to a resting position. This, in turn, moves the lever and returns the poppet to the starting position, at which the passage between the inlet and outlet chambers is closed once again.

In conventional second-stage regulators where the diaphragm and corresponding opening formed in the regulator body are circular in shape, the diaphragm is usually locked at an edge of the opening by a cover that is threadably engaged with, i.e., screws over, the opening. In the case of diaphragms and openings having a different shape, the diaphragm is typically positioned at the edge of the opening by attaching the cover to the regulator body by screws. While useful, the latter arrangement has been found unsatisfactory, in particular, during production, in requiring that metal bushings be provided inside the regulator body to serve as seats for the screws and, during assembly, by requiring tightening of the screws. Concurrently, there is also a need to increase the size of the diaphragm as much as possible to reduce the effort required by the scuba diver during inhalation, that is, to the extent that the overall dimensions of the regulator allow. To achieve this objective, however, diaphragms with a non-circular shape, particularly those having an oval shape, are desired that also have a suitable system for locking the diaphragm and closing the regulator.

OBJECTS AND SUMMARY OF THE INVENTION

Accordingly, it is an object of the present invention to provide a closure device of a second-stage regulator for scuba diving which overcomes the disadvantages during production and assembly of prior regulators, while accommodating the increased diaphragm size needed for reduced effort by a scuba diver during inhalation.

Another object of the present invention is to provide a closure device of a second-stage regulator for scuba divers that not only allows the diaphragm to be locked without screws, but also ensures that the resulting connection is secure from any risk of accidental opening.

According to one aspect of the present invention, there is provided a closure device of a second-stage regulator for scuba divers. The regulator comprises a regulator body with an inlet conduit for connection to a first-stage regulator which supplies a breathable gaseous mixture at a relatively constant pressure, an outlet conduit for connection to a mouthpiece of the user, and an opening closed by a deformable diaphragm. The device includes a locking frame connected in an articulated manner or jointedly to the regulator body to lock the diaphragm in the opening, a member being provided for fastening the frame to the regulator body.

BRIEF DESCRIPTION OF THE DRAWINGS

A specific, illustrative closure device of a second-stage regulator for scuba divers, in accordance with the present invention, is described below with reference to the accompanying drawings, in which:

FIG. 1 is a front perspective view of a second-stage regulator for scuba divers with a closure device, according to the present invention;

FIG. 2 is a side view of the regulator shown in FIG. 1;

The same numerals are used throughout the drawing figures to designate similar elements. Still other objects and advantages of the present invention will become apparent from the following description of the preferred embodiments.

DETAILED DESCRIPTION OF THE PREFERRED EMBODIMENTS

Figure 3:
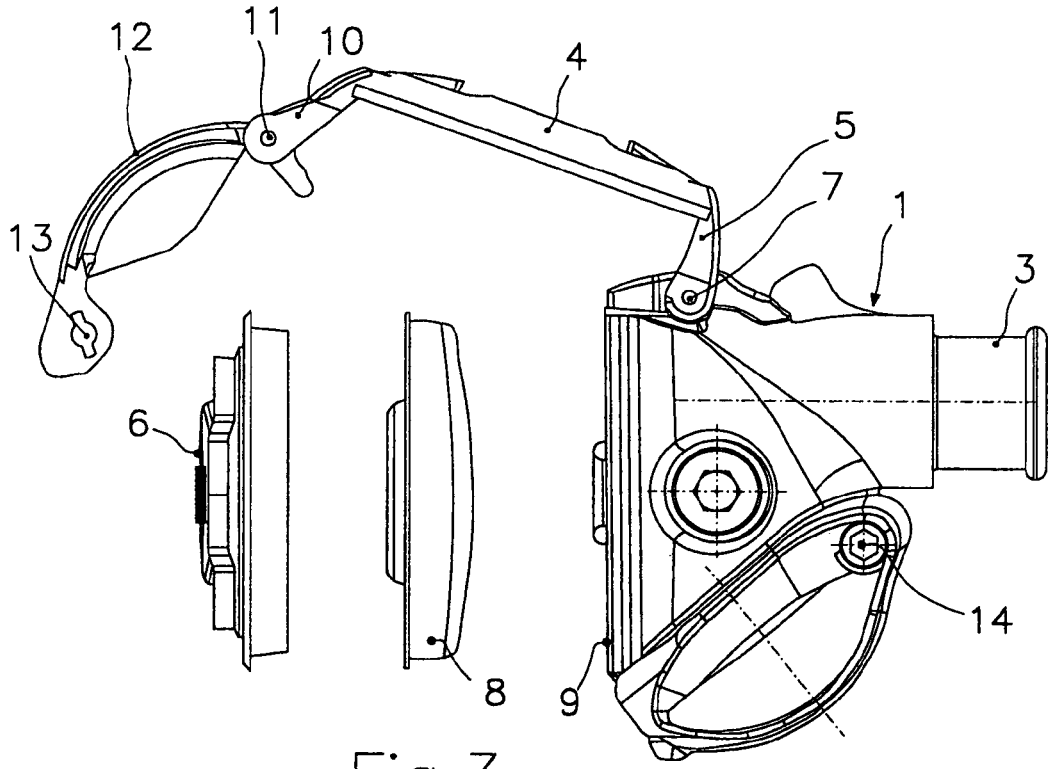
FIG. 3 is a partially exploded side view of the regulator shown in FIG. 1 with the closure device in an open position.

Referring now to the drawings and, more particularly, to FIGS. 1-6, there is shown generally a specific, illustrative closure device of a second stage regulator for scuba divers, in accordance with the present invention. According to one embodiment, illustrated generally in FIG. 1, the regulator has a body 1 with an inlet conduit 2 and an outlet conduit 3. The inlet conduit is preferably connected to a first-stage regulator which supplies a breathable gaseous mixture at a relatively constant pressure, while the outlet conduit is configured suitably so as to be removably retained by the scuba diver's mouth. i.e., via a mouth-piece.

As also illustrated in FIGS. 2 and 3, the second-stage regulator comprises a front frame 4 with an arm 5 extending radially therefrom. Arm 5 is hingedly mounted to the regulator body through a pin 7. A pushbutton 6 is provided centrally on frame 4 for controlling internal diaphragm 8, as best seen in FIG. 3. The frame serves both as a cover and to lock the edges of the diaphragm against edges of an opening 9 in regulator body 1.

Figure 4:
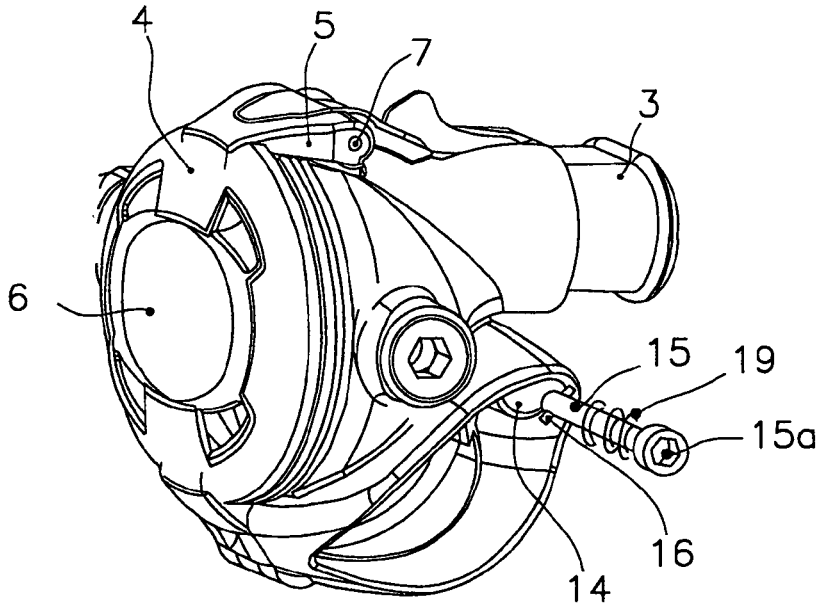
FIG. 4 is a perspective view of the regulator shown in FIG. 1 illustrating a member for locking the closure device.

The frame has, at an end diametrically opposed to arm 5, an additional arm 10 hingedly connected to a bracket 12 through a pin 11. As shown in FIG. 4, an elongated through hole 13 formed in the free end of bracket 12 aligns with a corresponding hole 14 in the regulator body when the frame is in a closed position. In this position, a pin 15 having a substantially T-shaped, enlarged end or head 16 allows the diaphragm to be locked above the regulator body.

Figure 5:
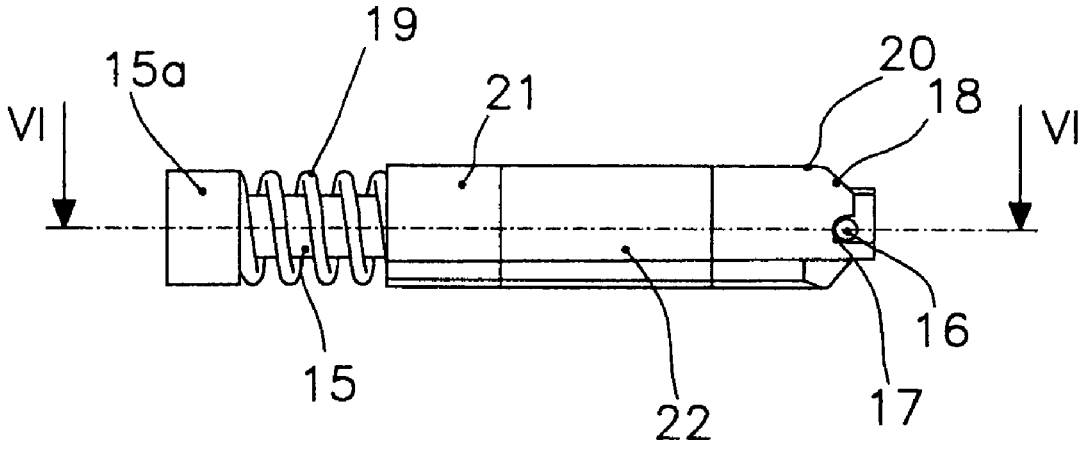
FIG. 5 is a side view of the member for locking the closure device illustrated in FIG. 1.
Figure 6:
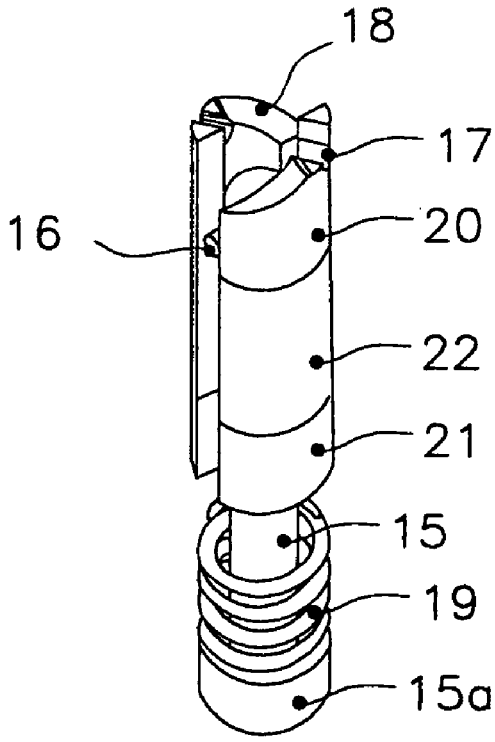
FIG. 6 is an isometric view of the locking member of FIG. 5.

As shown in FIGS. 4, 5 and 6, the enlarged head of pin 15 preferably includes a cross member which engages a seat 17 placed at the end of a cam profile 18. A spring 19, coaxial with the pin, maintains the cross member elastically in an engaged position within the seat. As indicated in FIGS. 5 and 6, elements 20 and 21 are integral with regulator body 1, whereas element 22 is a part of the end of bracket 12. Pin 15 desirably also comprises a head 15*a* having a prismatic cavity of such a shape as to require the use of a special key for its operation. In this manner, accidental or unwanted opening of the regulator and release of the bracket and frame, resulting in detachment of diaphragm 8, is prevented. By compressing the head so as to disengage the cross member of enlarged head 16 from seat 17, then rotating the member through 90°, and sliding it along cam 18 such that it passes through elongated hole 13 of bracket 12, the pin may be withdrawn therefrom.

Hence, the locking device formed by pin 15 is considered a safety device, frame 4 being snap-fastened to regulator body 1 by bracket 12 and its relative end with enlongated hole 13. Accordingly, once the frame is brought into the position shown in FIG. 4, it is already fastened securely to the regulator body.

Overall, the present invention advantageously maintains the transverse dimension of the regulator within the overall dimensions of the apparatus that surrounds it, while increasing the surface of the diaphragm such that it can be made in an elliptical shape. This provides a clear benefit to the user, in that because the surface of the diaphragm is larger, the vacuum that must be developed for inhalation is smaller and, hence, the user need make considerably less effort during inhalation.

Moreover, the elliptical shape lowers the diaphragm, while maintaining a generally parallel orientation, when the vacuum is generated inside the regulator, i.e., upon inhalation of the user.

Various modifications and alterations to the present invention may be appreciated based on a review of this disclosure. These changes and additions are intended to be within the scope and spirit of the invention as defined by the following claims.

What is claimed is:

1. A closure device of a second-stage regulator for scuba diving, the regulator comprising a regulator body with an inlet conduit for connection to a first-stage regulator which supplies a breathable gaseous mixture at constant pressure, an outlet conduit for connection to a mouthpiece of a user, and an opening closed by a deformable diaphragm, the device comprising a locking frame connected in an articulated manner to the regulator body to lock the diaphragm in the opening, a member being provided for fastening the frame to the regulator body, wherein the frame is connected in an articulated manner to a bracket having a free end which can be snap-attached to the regulator body.

2. A closure device of a second-stage regulator for scuba diving, the regulator comprising a regulator body with an inlet conduit for connection to a first-stage regulator which supplies a breathable gaseous mixture at constant pressure, an outlet conduit for connection to a mouthpiece of a user, and an opening closed by a deformable diaphragm, the device comprising a locking frame connected jointedly to the regulator body to lock the diaphragm in the opening, a member being provided for fastening the frame to the regulator body, wherein the member for attaching the frame to the regulator body comprises a pin with an enlarged substantially T-shaped end, passing through the free end of the bracket for snap-engagement with a seat of the regulator body as a result of its rotation around its longitudinal axis, an elastic member being provided coaxially to the pin, for opposing disengagement of the enlarged end from the seat.

3. A closure device of a second-stage regulator for scuba diving, the regulator comprising a regulator body with an inlet conduit for connection to a first-stage regulator which supplies a breathable gaseous mixture at constant pressure, an outlet conduit for connection to a mouthpiece of a user, and an opening closed by a deformable diaphragm, the device comprising a locking frame connected jointedly to the regulator body to lock the diaphragm in the opening, a member being provided for fastening the frame to the regulator body, wherein the member comprises a pin with an enlarged substantially T-shaped end, passing through the free end of the bracket for snap-engagement with a seat of the regulator body as a result of its rotation around its longitudinal axis, an elastic member being provided coaxially to the pin, for opposing disengagement of the enlarged end from the seat, and wherein the seat of the regulator body is formed between two symmetrical cam profiles acting as a guide for the enlarged end of the pin when, as a result of axial angular displacement of the latter, the enlarged end moves from a position of free axial sliding to a position of engagement within the seat.

4. The closure device set forth in claim 3, wherein the pin has a head with a generally prismatic seat for device operation.

5. A closure device of a second-stage regulator for scuba diving, the regulator comprising a regulator body with an inlet conduit for connection to a first-stage regulator which supplies a breathable gaseous mixture at constant pressure, an outlet conduit for connection to a mouthpiece of a user, and an opening closed by a deformable diaphragm, the closure device comprising a locking frame for locking the diaphragm in the opening, the locking frame being connected in an articulated manner to the regulator body, and a member for fastening the frame to the regulator body, the member comprising a bracket connected in an articulated manner to the frame and snap-attachable to the regulator body.

6. A closure device of a second-stage regulator for scuba diving, the regulator comprising a regulator body with an inlet conduit for connection to a first-stage regulator which supplies a breathable gaseous mixture at constant pressure, an outlet conduit for connection to a mouthpiece of a user, and an opening closed by a deformable diaphragm, the device comprising a locking frame connected jointedly to the regulator body to lock the diaphragm in the opening, a member being provided for fastening the frame to the regulator body, wherein the member comprises a pin with an enlarged, substantially T-shaped end, the bracket having a free end with a through hole, through which the enlarged end passes, to snap-enagage in a seat of the regulator body as a result of rotation of a pin around its longitudinal axis, an elastic member being provided coaxially to the pin, for opposing disengagement of the enlarged end from the seat.

7. The device set forth in claim 6, wherein the regulator body is formed with a hole aligned with the through hole of the free end of the bracket when the bracket is snap-engaged with the regulator body, and wherein the seat is formed at one end of the regulator body between two symmetrical cam profiles acting as a guide for the enlarged end of the pin when, as a result of axial angular displacement of the latter, the enlarged end moves from a position of free axial sliding to a position of engagement with the seat.

8. The device set forth in claim 2, wherein the pin has a head with prismatic seat for its operation.

9. The device set forth in claim 5, wherein an elongated through hole is formed on the free end of the bracket for allowing the passage of the enlarged end therethrough when the enlarged end is axially aligned therewith.

* * * * *